US005277112A

United States Patent [19]

Ohta et al.

[11] Patent Number: 5,277,112

[45] Date of Patent: Jan. 11, 1994

[54] INK REMOVING DEVICE FOR A LITHOGRAPHIC PRESS AND A METHOD FOR REMOVING INK FROM A LITHOGRAPHIC PRESS

[75] Inventors: Hideo Ohta, Tokyo; Masahiko Miyoshi, Ayase, both of Japan

[73] Assignee: Kabushikigaisha Tokyo Kikai Seisakusho, Tokyo, Japan

[21] Appl. No.: 899,603

[22] Filed: Jun. 12, 1992

[30] Foreign Application Priority Data

Jun. 28, 1991 [JP] Japan ..... 3-183527

[51] Int. Cl.[5] ..... B41F 35/02

[52] U.S. Cl. ..... 101/425; 101/148; 101/349; 101/450.1

[58] Field of Search ..... 101/147, 148, 205–211, 101/349–352, 365, 423, 424, 425, 450.1, 451, 452, DIG. 47

[56] References Cited

U.S. PATENT DOCUMENTS

| | | | |
|---|---|---|---|
| 2,253,158 | 8/1941 | Worthington | 101/365 |
| 3,236,178 | 2/1966 | Worthington et al. | 101/210 |
| 3,312,166 | 4/1967 | Gentile | 101/148 |
| 3,690,253 | 9/1972 | Dreyer | 101/450.1 |
| 3,741,118 | 6/1973 | Carley | 101/451 |
| 3,927,614 | 12/1975 | Malek | 101/148 |
| 4,143,596 | 3/1979 | Ivett | 101/148 |
| 4,508,034 | 4/1985 | Bolza-Schunemann | 101/DIG. 47 |
| 4,527,479 | 7/1985 | Dahlgren et al. | 101/450.1 |
| 4,922,821 | 5/1990 | Nozaka et al. | 101/423 |
| 4,972,200 | 11/1990 | Arahara et al. | 101/450.1 |
| 5,046,416 | 9/1991 | Freyer et al. | 101/425 |

FOREIGN PATENT DOCUMENTS

| | | | |
|---|---|---|---|
| 2931579 | 2/1981 | Fed. Rep. of Germany | 101/DIG. 47 |
| 3446675 | 6/1986 | Fed. Rep. of Germany | 101/148 |
| 72457 | 4/1983 | Japan | 101/425 |
| 145453 | 8/1983 | Japan | 101/349 |
| 149155 | 6/1988 | Japan | 101/425 |
| 230342 | 9/1988 | Japan | 101/DIG. 47 |
| 55249 | 3/1991 | Japan | 101/450.1 |

*Primary Examiner*—Edgar S. Burr
*Assistant Examiner*—Stephen R. Funk
*Attorney, Agent, or Firm*—Foley & Lardner

[57] ABSTRACT

A lithographic press includes a plate cylinder having an outer surface which includes a first outer section and a second outer section, and at least one printing plate disposed around one of the first and second outer sections in parallel to a rotational axis of the plate cylinder. The other of the first and second outer sections is uncovered and exposed to the ambient environment. The lithographic press also includes an ink supplying device which feeds ink to the at least one printing plate and the other of the first and second outer sections, and an ink removing device having a contact member which contacts the other of the first and second outer sections of the plate cylinder and removes ink therefrom. A method for removing ink from the other of the first and second outer sections includes removing the ink by way of contact between the ink removing device and the other of the first and second section of the outer surface of the plate cylinder.

11 Claims, 3 Drawing Sheets

INK REMOVING DEVICE FOR A LITHOGRAPHIC PRESS AND A METHOD FOR REMOVING INK FROM A LITHOGRAPHIC PRESS

BACKGROUND OF THE INVENTION

1. Field of the Invention

The present invention generally relates to a printing system and printing method using a lithographic press. More specifically, the present invention relates to a paricular type of printing system, such as a newspaper printing system, which includes a plurality of printing rollers arranged in parallel to the axis of a plate cylinder.

2. Description of the Related Art

It is well known that a lithographic printing method utilizes the typical repulsion phenomenon that occurs between water and oil ink, or between silicone and oil ink, to form various printing images. In such a method, image areas are non-image areas and formed on a substantially similar plano-surface of a printing plate, and then oil ink is supplied to the image sections to print the image on any required material, such as paper.

For example, many newspaper printing factories employ a double sized rotary press capable of printing on four pages at once. See for example, "Newspaper Manufacturing Technical Words", pp. 358, (conventional Art 1), published by Nippon Newspaper Association on Jun. 11, 1990. One typical structure of this type of printing apparatus is shown in FIG. 5 and includes a plurality of printing plates P, each of which has a thickness of about 0.3 mm and a width accommodating single or double pages. The printing plates P are securely arranged in parallel to the axis of a plate cylinder PC regardless of the existence of images. Ink is supplied to all the printing plates P at the same time from an ink dispenser 1. In the drawing, D, BC, IC and W represent a dampening means, a blanket cylinder, an impression cylinder, and a paper web, respectively.

Methods for washing/cleaning printing cylinders are well known as reflected in Japanese Patent Application Laid Open Publications No. 63-288754/1988 entitled "Cleaning Device for Cylinders in Printing Apparatus" (Conventional Art 2) and No. 2-141241/1990 entitled "Cleaning Device for Plate Cylinder and/or Blanket Cylinder" (Conventional Art 3).

The device disclosed in the conventional art 2 is designed so that the circumferential surface of the cylinder is cleaned by a cloth when the surface is soiled during a continuous printing operation, and is provided with a system which automatically detects any gaps such as grooves, openings, and the like in the cylinder. This gap detecting system prevent any gaps from being soiled by the cleaning cloth which is itself soiled during the cleaning operation.

The conventional art 3 discloses a cleaning device for removing any dirt, dust, or remaining ink from the circumferential surface of the plate cylinder and/or blanket cylinder. This cleaning device can perform the cleaning operation over several portions and/or broad areas, at the same time.

In the above mentioned newspaper press, especially in a color printing operation, a page with a non-image sometimes appears adjacent to a page printed with images. Since an ink dispenser feeds ink to all the plate cylinders, every cylinder is provided with a printing plate regardless of the presence of images, to prevent the surface of the plate cylinders from adhering with the supplied ink. If the plate cylinder corresponding to the page with non-image is not covered with a printing plate, the supplied ink will easily be transferred to the paper web from the cylinder surface. In this system the printing plate without images is used only for protecting the paper web from being soiled with ink during the printing operation, and therefore prevents the wasting of ink. This system increases manufacturing costs because it requires plate producing work, in addition to the plate itself.

The lithographic printing system, which uses the repelling function between oil ink and water, requires a dampening means for feeding water to the non-image area of each printing plate, thereby ensuring that the non-image area is free from ink. This dampening water may flow back to an inking dispenser, thus decreasing ink concentration, which may cause stripping; i.e., an inking roller of the inking system may repel ink, thereby interfering with the printing operation. A non-image printing plate, needs more dampening water, in comparison with normal printing plates that include images, and non-images. Accordingly, a lithographic such non-image printing plate may produce poorly printed sheets for a long time.

The above described devices shown in the conventional arts 2 and 3, also require the use of printing plates corresponding to blank pages. It is apparent that these two conventional devices can not resolve the problems described above.

BRIEF SUMMARY OF THE INVENTION

Therefore, it is a primary object of the invention to provide an improved printing system and printing method using a lithographic press which is able to reduce the running costs of the printing system.

Another object of the present invention is to provide an improved printing system and printing method using a lithographic press which can perform a constant and stable printing operation for a prolonged period of time without having any inking problems.

To satisfy these objects, in a lithographic press comprising a plate cylinder, with a printing plate area in which plural printing plates can be arranged in parallel to the axis of the cylinder, a printing method according to this invention includes an inking step for feeding ink to the printing plate area and an ink removing step which directly removes the ink from the printing plate area without the plate, and/or removing the ink via the circumferential surface of cylinders arranged at the downstream position of the plate cylinder, thereby performing the printing operation.

In a lithographic press comprising at least one cylinder, including a plate cylinder with a printing plate area in which plural printing plates can be arranged in parallel to the axis of the cylinder, and an inking dispense, for feeding ink to the printing plate arranged on the printing area, a printing system according to the invention includes an ink removing system which is provided with a contact member capable of contacting the circumferential surface of the printing plate area without the printing plate or the circumferential surface, corresponding to the printing plate area without the printing plate, of the cylinders arranged in the downstream of the plate cylinder.

Other objects and features of the invention will be apparent from the following description of the invention which makes reference to the accompanying drawings.

DETAILED DESCRIPTION OF THE PREFERRED EMBODIMENT

One preferred embodiment of the present invention will be described in detail, with reference to the accompanying drawings.

Figure 1:
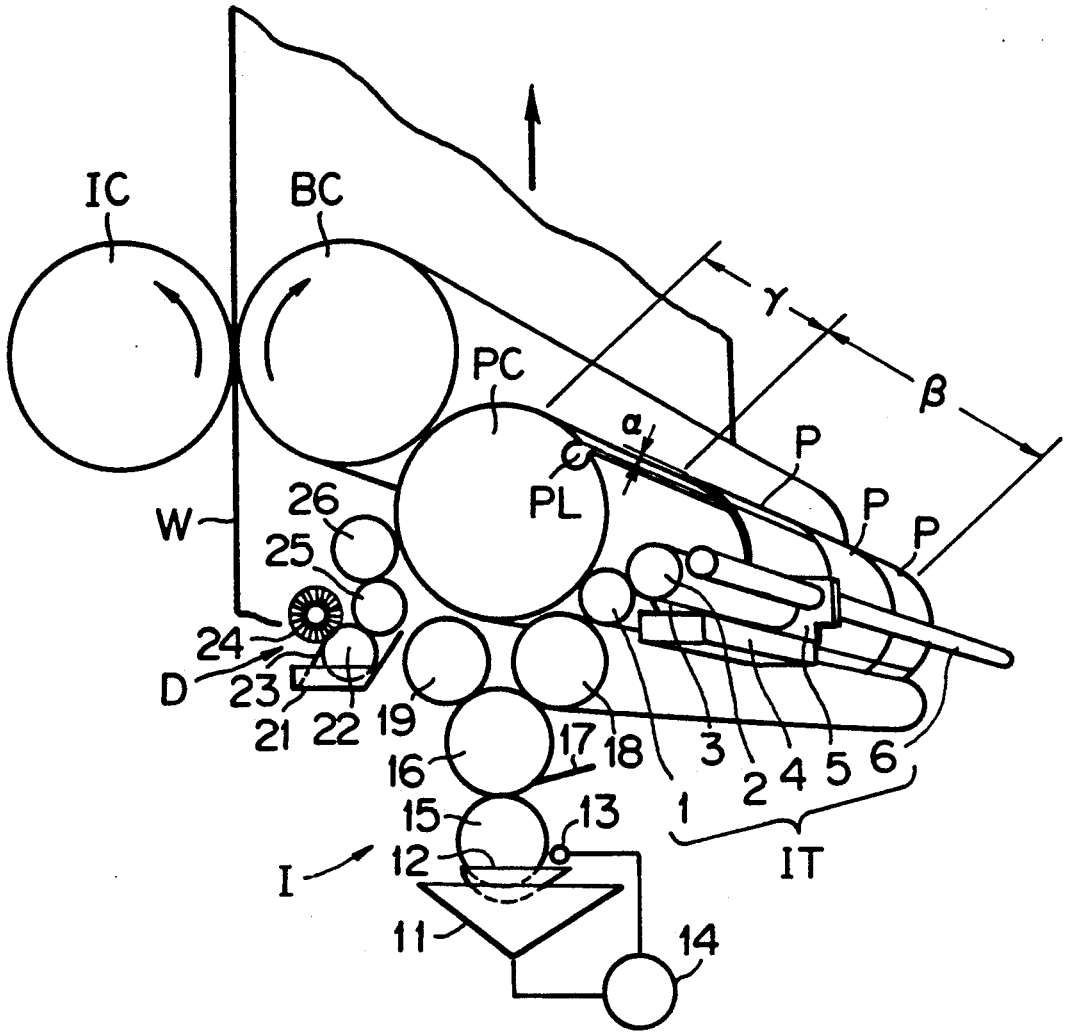
FIG. 1 is a partially perspective elevational view showing the overall configuration of one embodiment of the printing system according to the present invention.

In FIG. 1, an overall configuration of a printing system is shown which includes a plate cylinder PC which has printing sections, represented by $\beta$ and $\gamma$. The plate cylinder PC has four printing plates mounted thereon in parallel to the axis of the cylinder. The printing plates P which are mounted on the printing section $\beta$ correspond to image pages only, while no printing plates P are mounted on the printing section $\gamma$ corresponds to pages with having no image thereon. An ink removing means IT is fixedly set for section $\gamma$.

The ink removing system IT can be alternated between a contacting position and a separating position with respect to the circumferential surface of the blank page section $\gamma$. The ink removing system IT includes a contact roller 1, which is driven by the plate cylinder PC in the contacting position, an intermediate roller 2 which is driven by the contact roller 1, and a doctor blade 3 which is in contact with the circumferential surface of the intermediate roller 2, at the downstream position with respect to the contacting position with the contact roller 1. Further, the ink removing system IT includes a recovery tank 4 under the doctor blade 3. The recovery tank 4 is suspended by a pair of sub-frames 5 placed in opposition to each other (the front sub-frame is not shown in the drawing). The sub-frames 5 are supported by a pair of support rods 6 which are arranged in parallel fashion to the axis of the plate cylinder PC and fixed by any frame member, not shown. The sub-frames are slidable along the support rods 6 and can be fixed at any desired position.

An ink dispenser I for feeding ink to the plate cylinder PC comprises an ink fountain pan 11, an ink reservoir 12, an ink nozzle 13, a pump 14, an ink fountain roller 15 which rotates allowing it to partially dip into the ink in the ink reservoir 12, a metering roller 16 set at the downstream position of the fountain roller 15 and arranged in opposition to it, a doctor blade 17 set at the downstream position of the ink fountain roller 15 so that the doctor blade 17 is in contact with the circumferential surface of the metering roller 16, and inking rollers 18 and 19 which are in contact with both the metering roller 16, the plate cylinder PC and the plates P.

In this ink feeding system I, the ink in the ink fountain pan 11 is fed into the ink reservoir 12 through the ink nozzle 13 and the pump 14. When reservoir 12 overflows, the overflowing ink returns to the ink fountain pan 11. The ink fountain roller 15 transfers the ink from the ink reservoir 12 to the metering roller 16. The doctor blade 17 removes any excess ink from the metering roller 16. Then the amount controlled ink is fed to the printing plates P, mounted on the plate cylinder PC via the inking rollers 18 and 19.

A dampening system D, for feeding dampening water to the printing plates P comprises a water pan 21, a dampening fountain roller 22 whose rotation allows it to partially dip into the water in the water pan 21, a doctor blade 23 which is arranged in a parallel fashion with the axis of the dampening fountain roller 22 and is divided by the same length of the printing plate P, the divided sections of which are individually brought into contact with the circumferential surface of the fountain roller 22, brush roller 24 which is rotated thus bringing it into contact with the foutain roller 22 at the downstream position of the doctor blade 23, an intermediate roller 25 facing the contacting position between the fountain roller 22 and the brush roller 24, and a dampening roller 26 contacting and interposed between the intermediate roller 25 and the plate cylinder PC.

In this dampening system D, the water is led from the water pan 21 by the circumferential surface of the fountain roller 22, and is then splashed onto the circumferential surface of the intermediate roller 25 by the resilient motion of the brush of the brush roller 24. Finally, the water is transfered to the printing plate P set on the plate cylinder PC through the dampening roller 26.

In the dampening operation of this dampening system D, since the divided sections of the doctor blade 23 can be selectively brought into contact with the circumferential surface of the fountain roller 22, only the divided sections corresponding to the blank page section $\gamma$ which does not need the dampening water are operated to prevent the blank page section $\gamma$ on the plate cylinder PC from receiving dampening water from the water pan 21.

Further, the printing system shown in FIG. 1 consists of a blanket cylinder BC, an impression cylinder IC and a paper web W.

The printing system described above is energized by a drive motor not shown. The printing plates P set on the plate cylinder PC, are provided with ink by the ink dispenser I and are simultaneously provided with the dampening water by the dampening system D. The ink is fed only to the portion of the printing plate P which corresponds to the image and is transferred via the blanket, not shown, which is mounted on the blanket cylinder BC, to the paper web which is moved by driving motion of the blanket cylinder BC and the impression cylinder IC.

Although the surface level of the blank page section $\gamma$ is less by the thickness $\alpha$ of the printing plate P than the image printing plate section ($\alpha$ is about 0.3 mm), the inking rollers 18 and 19 of the ink feeding means I are forcibly depressed onto the plate cylinder PC so that their elastic circumferential surfaces are slightly deformed. Therefore the ink can be transfered to not only the image printing section $\beta$ but also the blank page section $\gamma$. On the other hand, the plate cylinder PC is also forcibly depressed onto the blanket cylinder BC so that the blanket surface of the blanket cylinder BC is slightly deformed. Accordingly, if the ink is not removed from the blank page section $\gamma$, the ink will be gradually increased during the printing operation and finally transferred to the paper web W through the blanket cylinder BC.

To remove the ink from the blank page section $\gamma$, the contact roller 1 of the ink removing means IT is brought into contact with the blank page section $\gamma$ to transfer the ink therefrom. The transferred ink is then scraped by the doctor blade 3 through the intermediate roller 2. Finally the scraped ink is gathered by the recovery tank 4.

Figure 2:
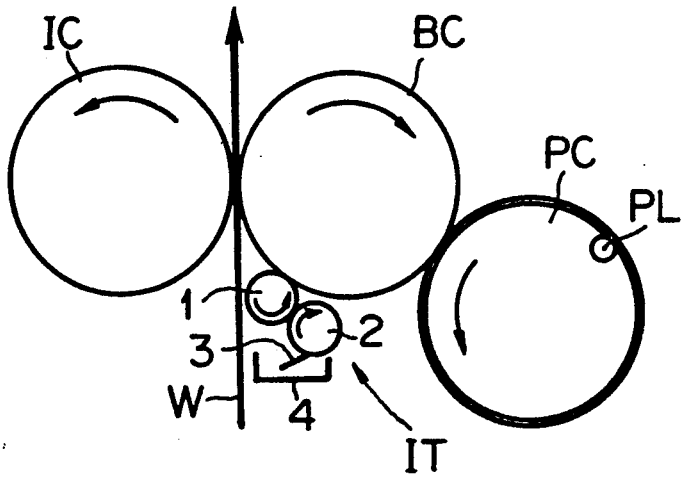
FIG. 2 is an enlarged side elevational view showing the main components of the printing system of FIG. 1, wherein an ink removing means is set up for a blanket cylinder.

In another modification, as shown in FIG. 2, the ink removing means IT may be arranged for the blanket cylinder BC to remove the unnecessary ink from the blank page section $\gamma$ through the blanket mounted on the blanket cylinder BC.

Figure 3:
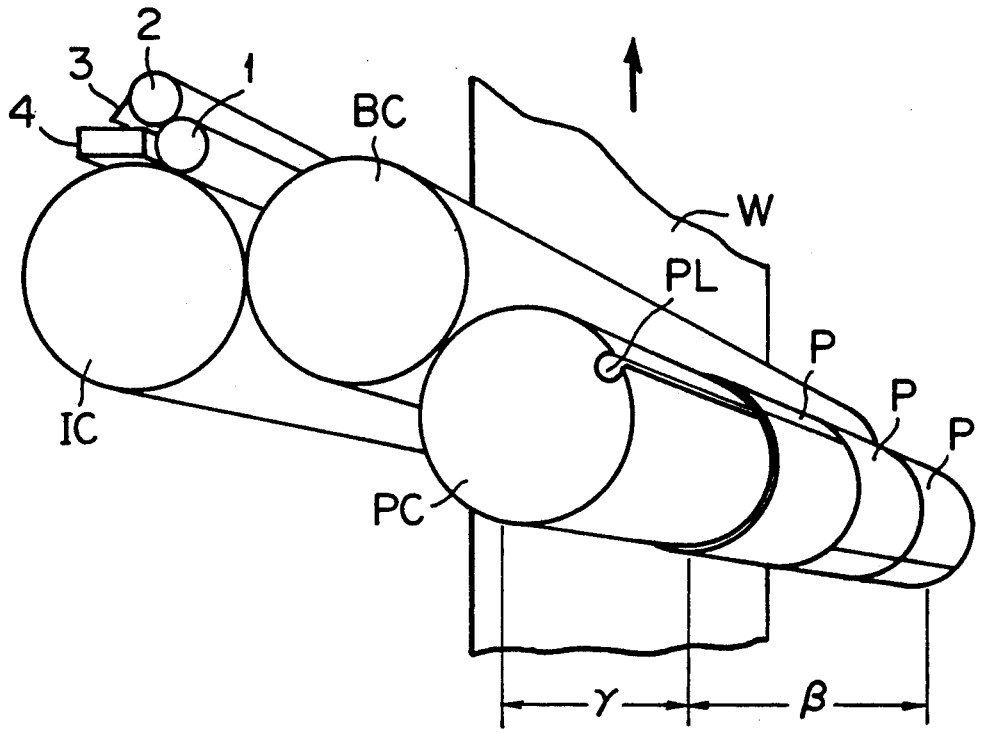
FIG. 3 is a perspective view showing only the main components of the printing system of FIG. 1, wherein an ink removing means is set up for an impression cylinder.

In another modification, as shown in FIG. 3, the ink removing means IT may be arranged for the impression cylinder IC when the width of the paper web W is consistent with that of the printing section (three plates in FIG. 3). In this case, the unnecessary ink from the blank page section $\gamma$ is transferred to the circumferential surface of the impression cylinder IC through the blanket of the blanket cylinder BC. Thus the ink removing means IT can remove the unnecessary ink from the impression cylinder IC.

Figure 4:
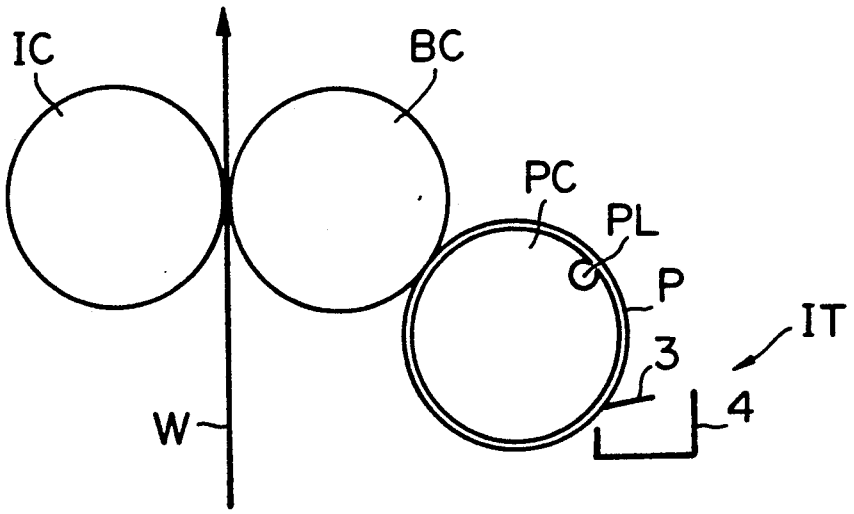
FIG. 4 is a side elevational view showing only the main components of the printing system of FIG. 1, wherein the ink removing means is modified.
Figure 5:
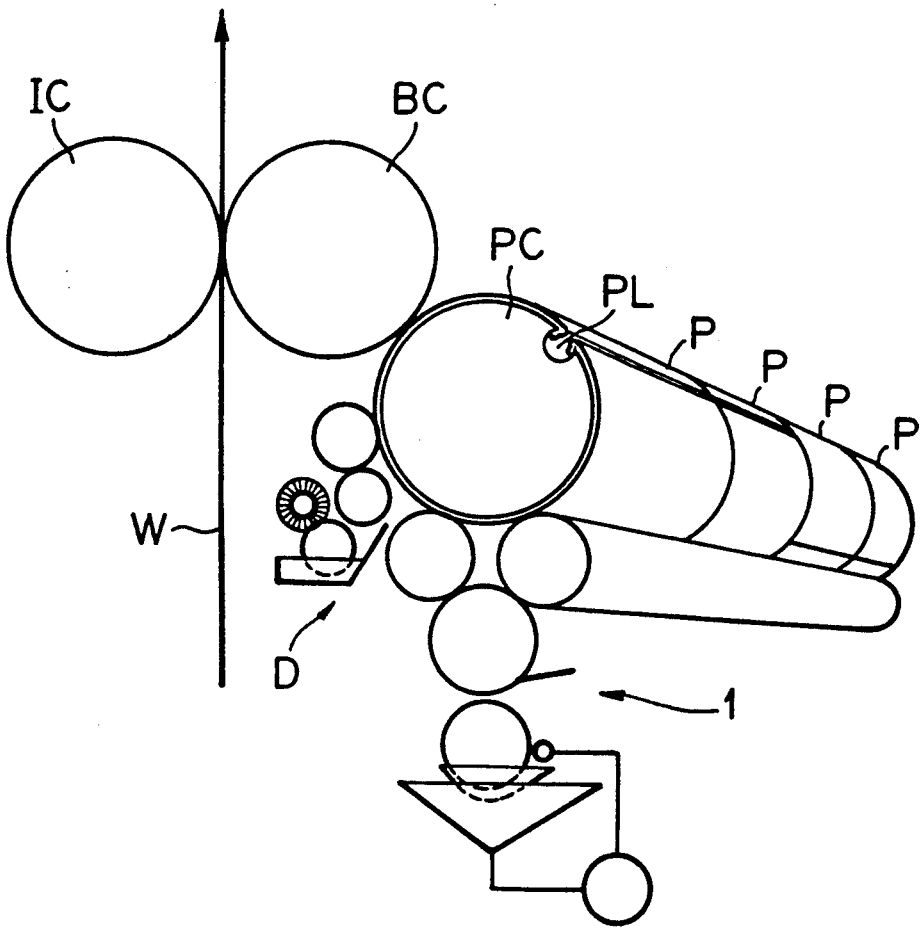
FIG. 5 PRIOR ART
FIG. 5 is a partial perspective view showing a conventional double width type rotary press.

In a further modification, as shown in FIG. 4, the ink removing means IT may be composed of the doctor blade 3 which is contact with the surface to be removed (the circumferential surface of the plate cylinder PC in this drawing), and the recovery tank 4. In this case, any resilient mechanism such as a combination of cam and cam follower, not shown, may be added to the doctor blade 3 to prevent the doctor blade 3 from suffering with uneveness or gap formed in the circumferential surface of the plate cylinder PC. This gap may be sometimes formed in the connection line PL of the printing plate P.

The ink removing means IT composed of the doctor blade 3 which is contact with the surface to be removed and the recovery tank 4 may be also arranged for the blanket cylinder BC or the impression cylinder IC.

In these drawings, the printing plates P are illustrated in a remarkably thick shape to facilitate the understanding of the invention. FIG. 1 shows that the circumferential surface of the plate cylinder PC without the printing plate is isolated from the inking rollers 18 and 19, and the blanket cylinder BC in order to more clearly define between the image printing section $\beta$ and the blank page section $\gamma$ in the figure. As discussed previously, the inking rollers 18 and 19 are pressed onto the plate cylinder PC during inking.

According to the above described embodiment, the blank page plate(s) required in conventional lithographic printing systems can be eliminated, thereby decreasing the work associated with preparing the blank page plate and the overall printing cost.

Further, the lithographic printing system according to the present invention eliminates the mixing of the ink feeding means with the dampening water that typically flows from the blank page plate. Therefore, the printing quality can be maintained at a high level by feeding a constant concentration of ink even though the printing operation is continued for a long period of time.

It is apparent that many different embodiments and variations of this invention may be made without departing from the spirit and scope thereof, and it is understood that the invention includes such different embodiments and variations and is not limited to the specific embodiments described herein.

What is claimed is:

1. A printing method comprising the steps of:

(a) providing a lithographic press having a plate cylinder which includes an outer surface, the outer surface including a first section having a printing plate disposed thereon in parallel to an axis of rotation of the plate cylinder and a second section which does not have a printing plate thereon and which is exposed to the ambient environment, the first and second sections being disposed axially along the axis of rotation of the plate cylinder, (b) concurrently feeding ink to the printing plate and the second section of the outer surface;

(c) removing ink from the second section of the outer surface area; and (d) transferring the ink from the printing plate to a paper web.

2. A printing method as recited in claim 1, wherein step (c) includes engaging a contact roller against the second section to remove ink therefrom and transferring the removed ink to a receiving tank.

3. A printing method according to claim 1, wherein during step (c) ink is removed from the second section via respective circumferential surfaces of a plurality of additional cylinders, the respective circumferential surfaces of each of the additional cylinders being in contact with the circumferential surface of at least one other of the additional cylinders and at least one of the additional cylinders being in contact with the second section of the plate cylinder.

4. A lithographic press comprising:

a plate cylinder having an outer surface which includes first and second outer surface sections;

at least one printing plate disposed around one of the first and second outer surface sections in parallel to a rotational axis of the plate cylinder, the other of the first and second outer surface sections being uncovered and exposed to the ambient environment, the first and second outer surface sections being disposed axially along the rotational axis of the plate cylinder;

an ink supplying device which feeds ink to the at least one printing plate and the other of the first and second outer surface sections; and an ink removing device having a contact member which contacts the other of the first and second outer surface sections of the outer surface of the plate cylinder thereby removing ink therefrom, and allowing ink to be transferred from the at least one printing plate to a paper web.

5. A lithographic process according to claim 4, wherein the other of the first and second outer surface sections of the plate cylinder is a non-image forming surface such that the other of the first and second outer surface sections of the plate cylinder does not contribute to the transfer of an image to the paper web.

6. A lithographic process according to claim 5, further comprising a dampener which selectively feeds water to different locations along the plate cylinder.

7. A lithographic process according to claim 4, wherein the ink removing device is movable between a first position in which the ink removing device contacts the other of the first and second outer surface sections and a second position in which the ink removing device is separated from the other of the first and second surface outer sections.

8. A lithographic process according to claim 7, wherein the ink removing device includes a contact roller which is driven by the at least one printing cylinder when the ink removing device is in the first position, an intermediate roller which is driven by the contact roller, and a doctor blade which is in contact with a circumferential surface of the intermediate roller.

9. A lithographic process according to claim 8, further comprising a recovery tank, a support frame, and a pair of support rods from which the support frame is supported, and wherein said recovery tank is connected to the support frame and the support frame is slidable along the support rods.

10. A lithographic process according to claim 4, wherein the ink removing device includes a blanket cylinder which is in contact with the other of the first and second outer surface sections of the plate cylinder, an impression cylinder which is in contact with the blanket cylinder, and at least one other cylinder which contacts the impression cylinder, and wherein ink is transferred from the other of the first and second outer surface sections to the blanket cylinder and from the blanket cylinder to the impression cylinder, and is subsequently removed from the impression cylinder via the at least one other cylinder.

11. A lithographic process according to claim 4, further comprising a blanket cylinder which contacts the other of the first and second outer surface sections and at least one additional cylinder which contacts an outer surface of the blanket cylinder, and wherein ink from the other of the first and second outer surface sections of the plate cylinder is transferred to the blanket cylinder and is removed from the blanket cylinder via at least one additional cylinder.

* * * * *